US010596403B2

(12) United States Patent
Lin

(10) Patent No.: US 10,596,403 B2
(45) Date of Patent: Mar. 24, 2020

(54) LOW VIBRATION AND NOISE REDUCTION EXERCISE MAT UNIT

(71) Applicant: Vincent Lin, Kaohsiung (TW)

(72) Inventor: Vincent Lin, Kaohsiung (TW)

( * ) Notice: Subject to any disclaimer, the term of this patent is extended or adjusted under 35 U.S.C. 154(b) by 277 days.

(21) Appl. No.: 15/790,054

(22) Filed: Oct. 23, 2017

(65) Prior Publication Data

US 2018/0117380 A1 May 3, 2018

(30) Foreign Application Priority Data

Oct. 28, 2016 (TW) ..... 105216527 U

(51) Int. Cl.
*A63B 6/02* (2006.01)
*A63B 21/00* (2006.01)
*A63B 21/078* (2006.01)

(52) U.S. Cl.
CPC ..... *A63B 6/02* (2013.01); *A63B 21/4037* (2015.10); *A63B 21/0783* (2015.10); *A63B 2210/50* (2013.01)

(58) Field of Classification Search
CPC ... E04F 15/225; E04F 15/02161; E04F 15/10; E04F 15/105; E04F 15/02038; A63B 6/02; A63B 6/00
See application file for complete search history.

(56) References Cited

U.S. PATENT DOCUMENTS 4,429,068 A * 1/1984 Nakahira ..... A43B 13/181 152/310
5,695,867 A * 12/1997 Saitoh ..... B32B 15/04 428/219
6,418,691 B1 * 7/2002 Stroppiana ..... E01C 13/045 52/403.1
7,757,449 B2 * 7/2010 Portoles Ibanez ..... E04F 15/02016 404/35
D707,372 S * 6/2014 Prins ..... D25/163
9,631,375 B1 * 4/2017 Barlow ..... E04F 15/187
2008/0072513 A1 * 3/2008 Swank ..... A63B 6/00 52/403.1
2010/0293877 A1 * 11/2010 Harris ..... E04F 15/10 52/302.1
2013/0139464 A1 * 6/2013 DeLong ..... E04B 5/00 52/588.1

(Continued)

FOREIGN PATENT DOCUMENTS

EP 0688921 A1 * 12/1995 ..... E04F 15/10

*Primary Examiner* — Christine T Cajilig
(74) *Attorney, Agent, or Firm* — Hershkovitz & Associates, PLLC; Abe Hershkovitz

(57) ABSTRACT

A low vibration and noise reduction exercise mat unit has a buffer plate and multiple protruding portions. The buffer plate has a board, multiple male buckles, and multiple female buckles. The board is quadrilateral and has a bottom, a recess, and a flange. The recess is formed on a bottom surface of the board. The flange is formed around the recess. The multiple protruding portions are disposed at spaced intervals in the recess of the board. The multiple protruding portions protrude downwardly from an inner top surface of the recess of the board. The buffer plate and the multiple protruding portions are made of natural rubber, will not affect the human body, and are stable in quality. The male buckles and female buckles can enhance the connecting strength between the mat units.

12 Claims, 9 Drawing Sheets

(56) References Cited

U.S. PATENT DOCUMENTS

2016/0375296 A1* 12/2016 Downey ..... A63B 21/4037
52/506.01

* cited by examiner

LOW VIBRATION AND NOISE REDUCTION EXERCISE MAT UNIT

BACKGROUND OF THE INVENTION

1. Field of the Invention

The present invention relates to an exercise mat unit, especially to a low vibration and noise reduction exercise mat unit.

2. Description of Related Art

People gradually pay more and more attention to their muscle training with the continuous development of fitness trend. People would use fitness equipment for muscle training to make their muscles become more solid.

Take weight lifting for example. Weight lifting is to lift a certain weight of the barbell to reach the effect of training muscular strength. For the purpose of training muscular strength, the exercise mat is spread on the ground, and then the user will stand on the exercise mat to lift the barbell.

The conventional exercise mat is assembled by multiple mat units. The commercially available exercise mat unit is made of recycled rubber. In the production of the exercise mat unit, toxic substances such as toluene and formaldehyde are used in the process of combining and reshaping the recycled rubber. Therefore, the human body is under a high risk of cancer. When the exercise mat unit is affected by the external force or weather, it is easy to have problems such as fragmentation, warpage and particle stripping.

In addition, many people often directly let the barbell fall on the exercise mat due to exhaustion and other reasons during the barbell lifting. This would cause the buckle of the exercise mat to depart easily because of the impact of the barbell falling off, and when the barbell falls on the exercise mat, the barbell will bounce up due to the elasticity of the exercise t surface and produce high frequency noise and low frequency vibration. The bouncing barbell may also hit the user.

To overcome the shortcomings of the conventional exercise mat unit, the present invention provides a low vibration and noise reduction exercise mat unit to mitigate or obviate the aforementioned problems.

SUMMARY OF THE INVENTION

The main objective of the present invention is to provide a low vibration and noise reduction exercise mat unit which may be operated safely.

The low vibration and noise reduction exercise mat unit has a buffer plate and multiple protruding portions. The buffer plate has a board, multiple male buckles, and multiple female buckles. The board is quadrilateral and has a bottom, a recess, and a flange. The recess is formed on a bottom surface of the board. The flange is formed around the recess. The multiple protruding portions are disposed at spaced intervals in the recess of the board. The multiple protruding portions protrude downwardly from an inner top surface of the recess of the hoard. The buffer plate and the multiple protruding portions are made of natural rubber, will not affect the human body, and have stable quality. The male buckles and female buckles can enhance the connecting strength between the mat units.

Other objects, advantages, and novel features of the invention will become more apparent from the following detailed description when taken in conjunction with the accompanying drawings.

DETAILED DESCRIPTION OF PREFERRED EMBODIMENT

Figure 1:
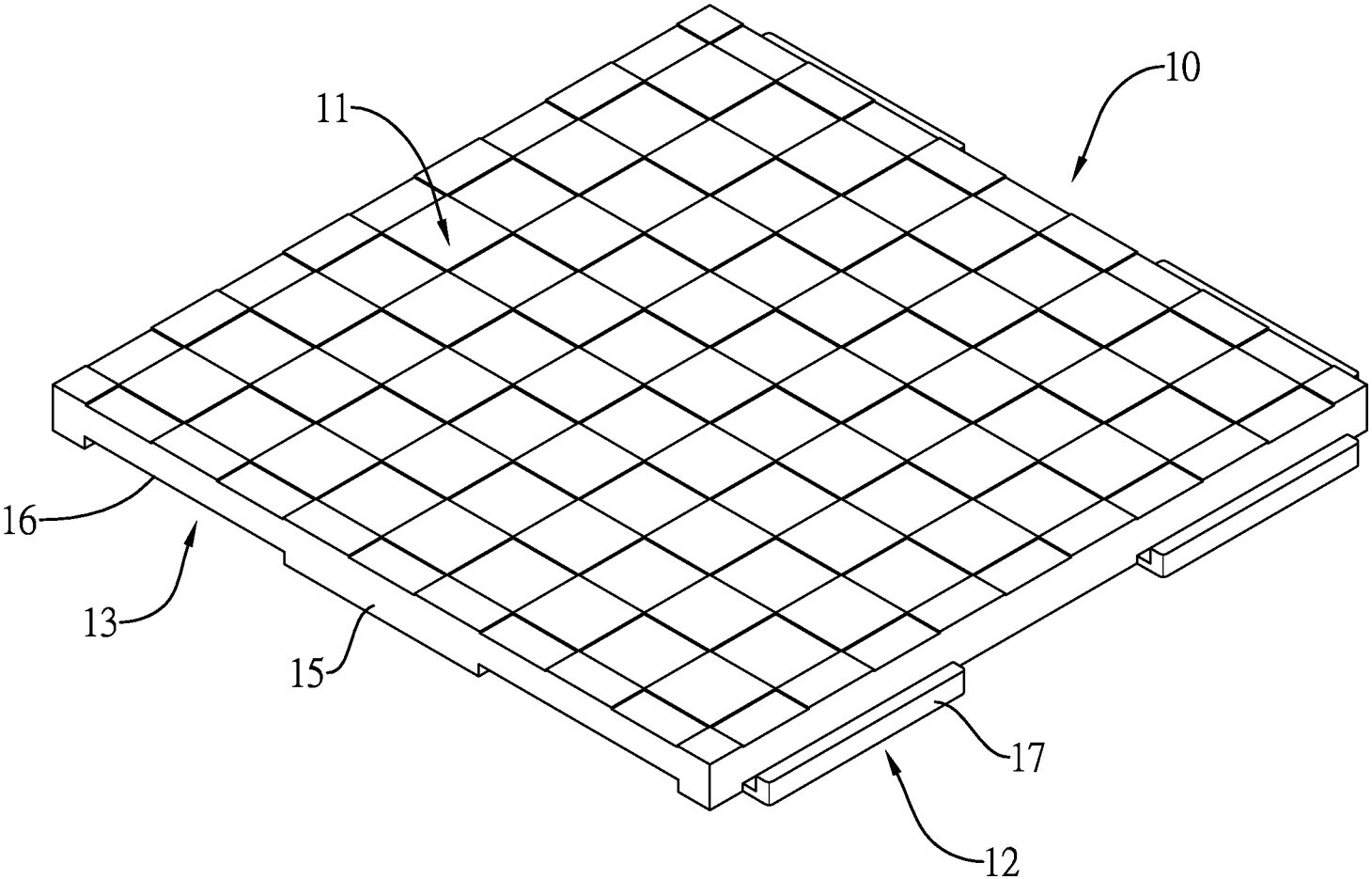
FIG. 1 is a perspective view of a low vibration and noise reduction exercise mat unit in accordance with the present invention.
Figure 2:
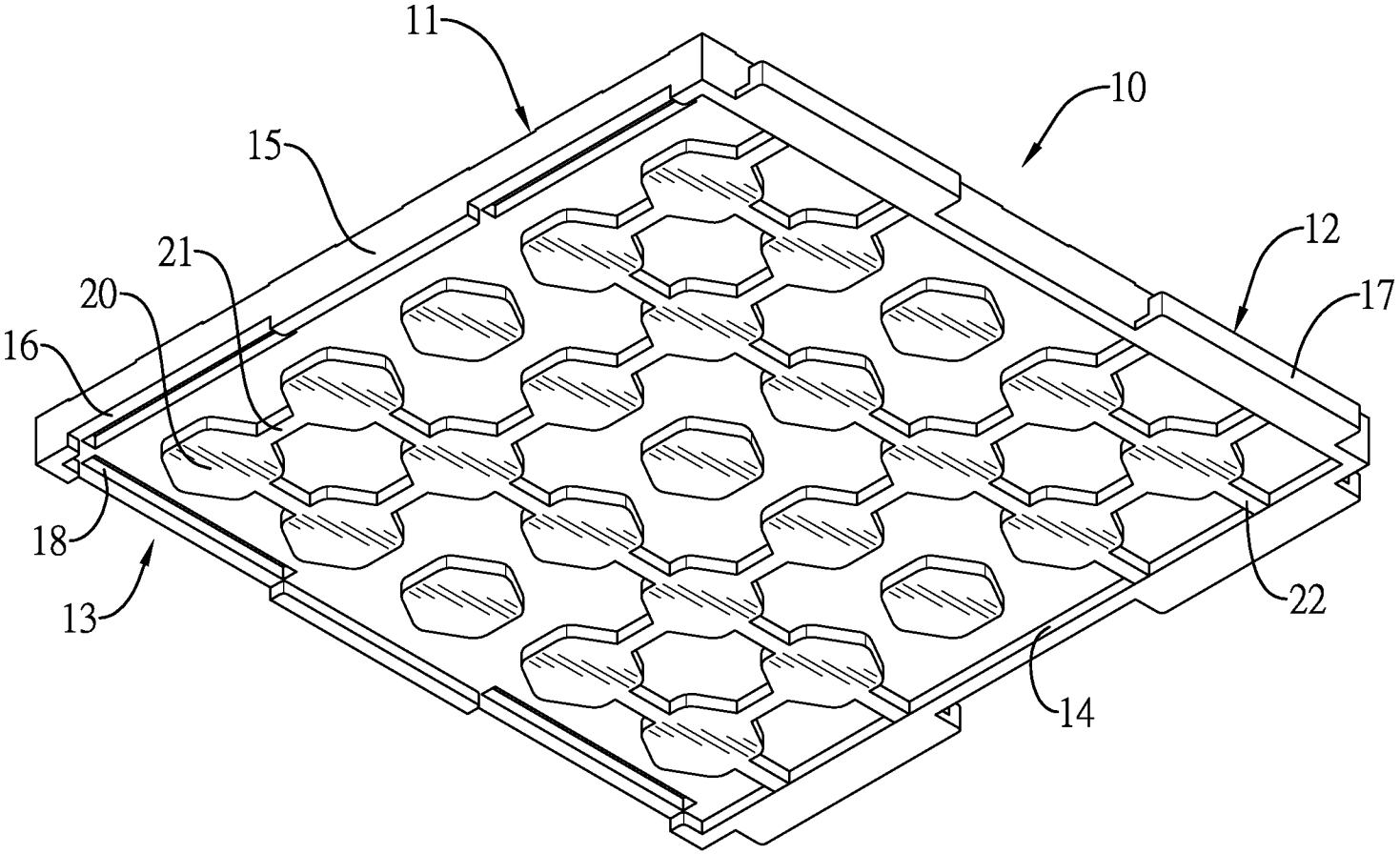
FIG. 2 is another perspective view of the exercise mat unit in FIG. 1.
Figure 3:
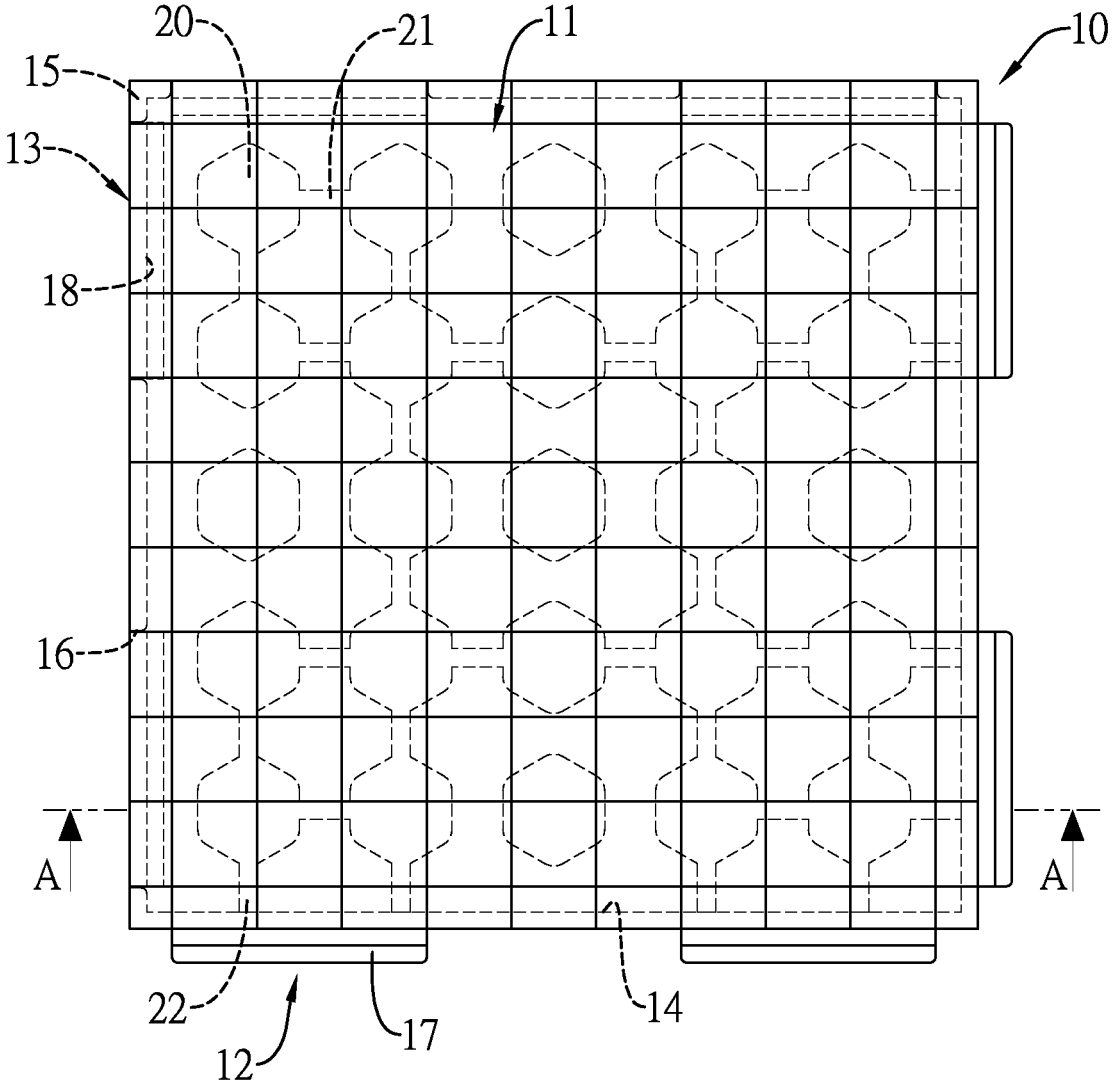
FIG. 3 is a bottom view of the exercise mat unit in FIG. 1.
Figure 4:
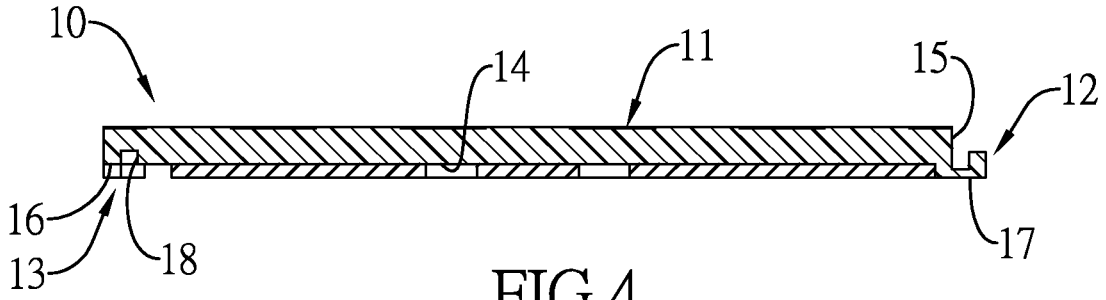
FIG. 4 is a cross sectional side view of the reduction exercise mat unit along the line 3-3 in FIG. 3.

With reference to FIGS. 1 to 3, a low vibration and noise reduction exercise mat in accordance with the present invention comprises a buffer plate 10 and multiple protruding portions 20. The buffer plate 10 and the multiple protruding portions 20 are made of rubber.

With reference to FIGS. 1 and 2, the buffer plate 10 has a board 11, multiple male buckles 12, and multiple female buckles 13. The board 11 is quadrilateral and has a bottom, a periphery, a recess 14, and a flange 15. The recess 14 is formed in a bottom surface of the board 11. The flange 15 is formed around the recess 14. The flange 15 has a notch 16, and the notch 16 is formed in the flange 15 at a position adjacent to the female buckles 13. The multiple male buckles 12 and the multiple female buckles 13 are formed on the board 11. The male buckles 12 and the female buckles 13 are arranged around the periphery of the board 11. Preferably, the board 11 has two pairs of two adjacent sides, the male buckles 12 are formed on one of the pairs of two adjacent sides, and the female buckles 13 are formed on the other pair of two adjacent sides. Each one of the male buckles 12 has a hook 17 protruding upward and formed on a top surface of the male buckle 12. Each one of the female buckles 13 has a groove 18 formed in the board 11 and located in the recess 14. Preferably, a thickness of the buffer plate 10 is 29.82 (mm) to 30.18 (mm).

With reference to FIGS. 2 and 3, the multiple protruding portions 20 are disposed at spaced intervals in the recess 14 of the board 11. The multiple protruding portions 20 protrude downwardly from an inner bottom surface of the recess 14. The hardness of the multiple protruding portions 20 is lower than the hardness of the buffer plate 10. First connecting ribs 21 are each respectively formed between some adjacent two of the protruding portions 20, second connecting ribs 22 are each respectively formed between the male buckles 12 and the protruding portions 20, and the connecting ribs 21,22 are made of rubber. The hardness of the connecting ribs 21, 22 and the hardness of the protruding portions 20 are the same. The bottom surface of the protruding portions 20 is flush with the bottom surface of the flange 15, and the protruding portions 20 may be circular, oval or polygonal in shape.

The buffer plate 10 is made of rubber having a hardness (JIS K 6301 A) of 80° to 90°, and the protruding portions 20 are made of rubber having a hardness (JIS K 6301 A) of 35° to 55°. The shapes of the protruding portions 20 are hexagonal as shown in FIGS. 2 and 3.

Figure 5:
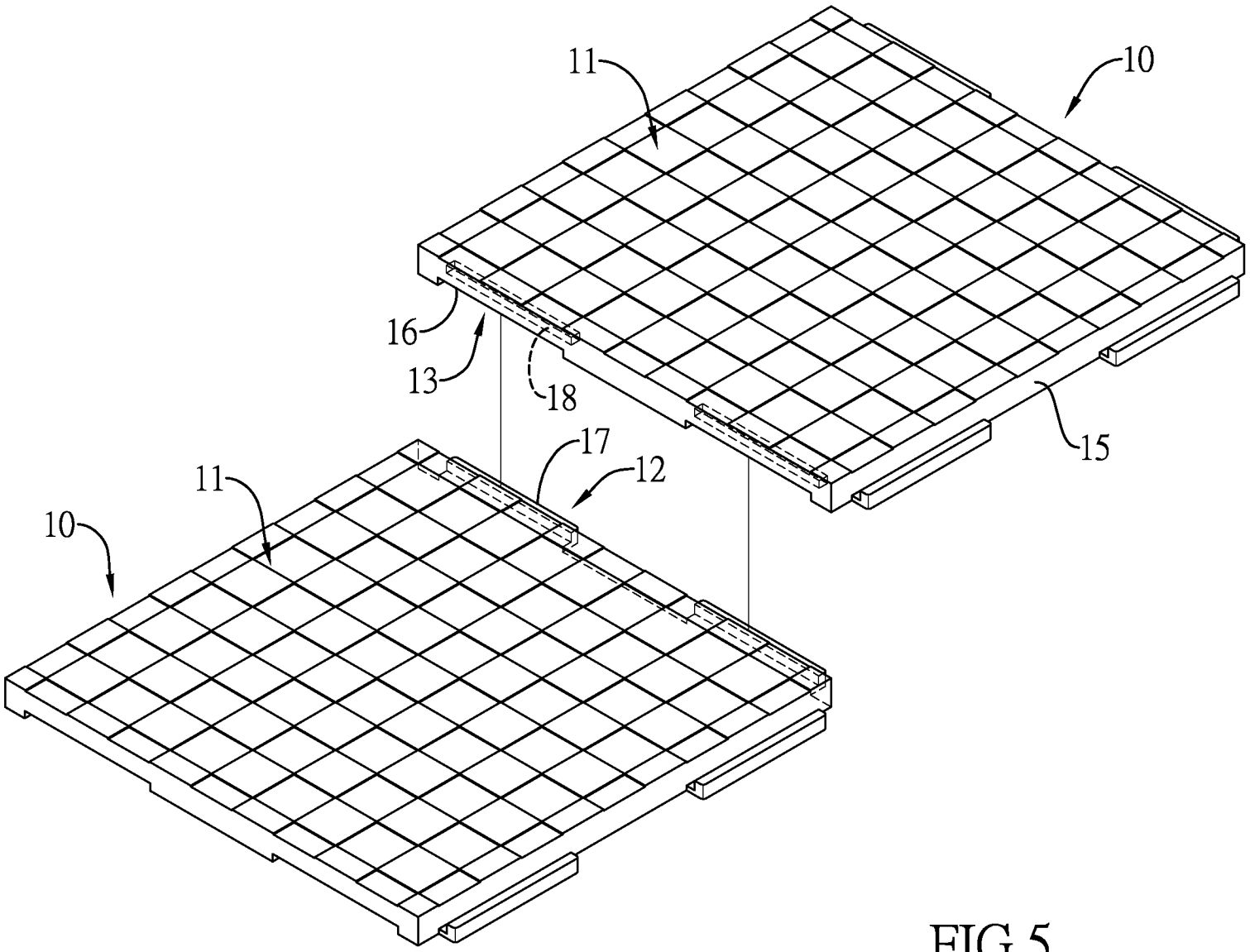
FIG. 5 is an operational exploded perspective view of two exercise mat units in FIG. 1 assembled with each other.
Figure 6:
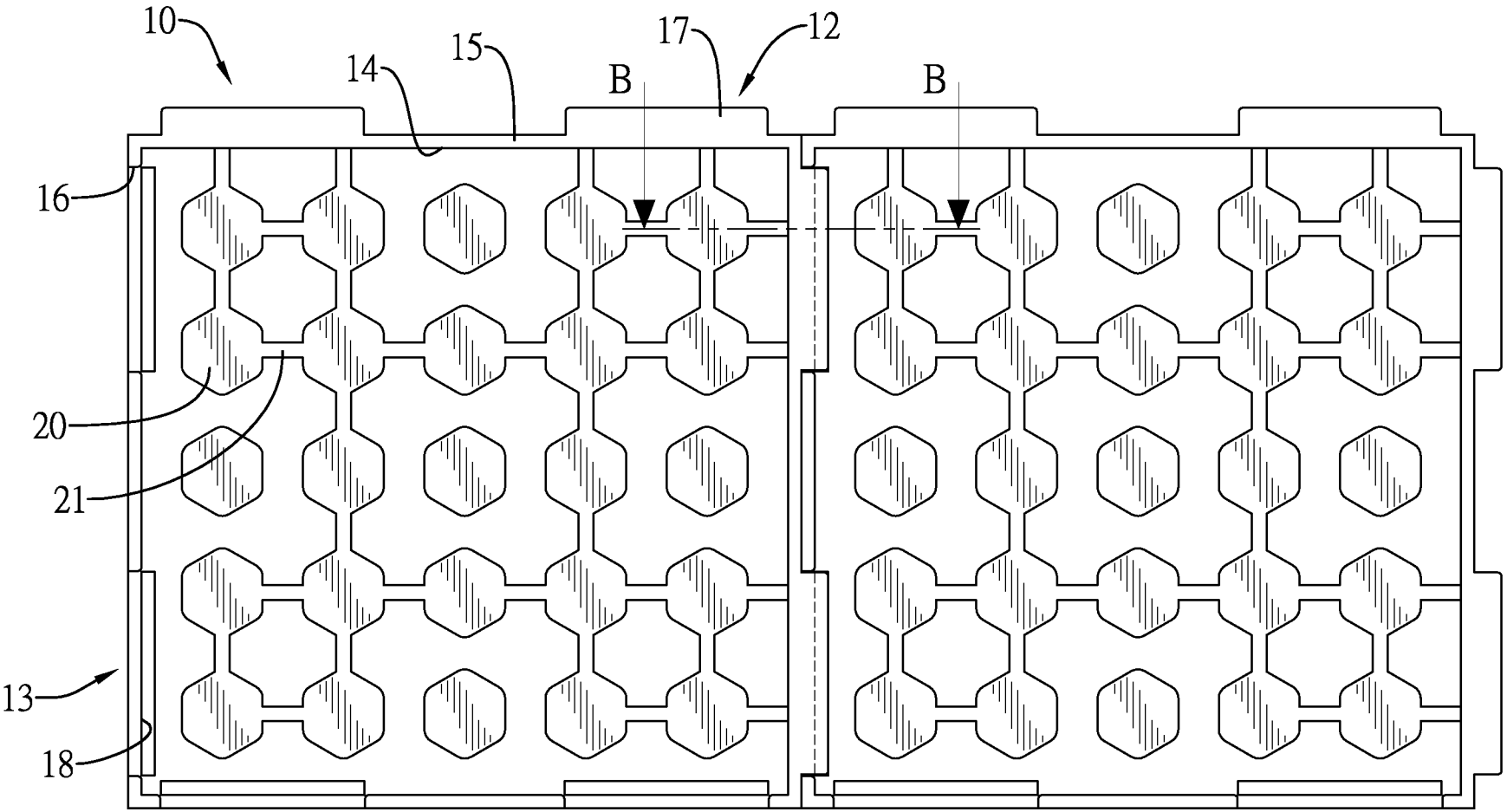
FIG. 6 is a bottom view of the reduction exercise mat units in FIG. 5.
Figure 7:
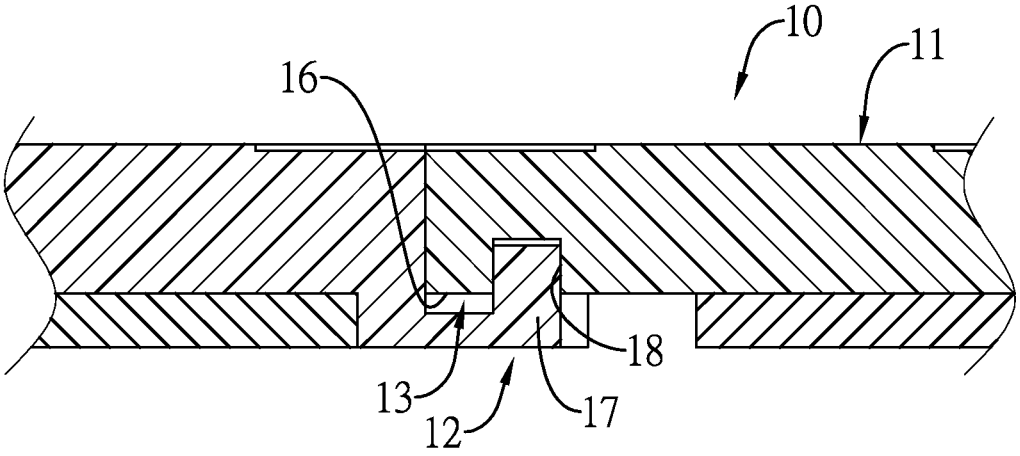
FIG. 7 is an enlarged cross sectional side view of the exercise mat units along the line 7-7 in FIG. 6.

With reference to FIGS. 5 and 6, the user can assemble an exercise mat by assembling multiple low vibration and noise reduction exercise mat units. In the process of assembling the exercise mat, the male buckles 12 are engaged with the female buckles 13. With reference to FIG. 7, the hook 17 of the male buckle 12 is inserted through the notch 16 of the flange 15 of the board 11, and the hook 17 of the male buckle 12 extends into the corresponding groove 18 of the female buckle 13, and the top surfaces of the buffer plate 10 are flush with each other.

When multiple exercise mat units in accordance with the present invention are assembled into an exercise mat, the users may do weight lifting or other exercises on the exercise mat. Since the hardness of the exercise mat is high, when the users lift the barbell or do exercise on the exercise mat, the number of bouncing after the barbell impacts the exercise mat reduces. The protruding portions 20 can absorb the noise when the barbell is impacted by the exercise mat and reduce the vibration. With the engagement of the male buckles 12 and the female buckles 13, the exercise mat units may not be separated when the exercise mat is impacted by the barbell.

In summary, the buffer plate 10 and the protruding portions 20 are made of natural rubber. The exercise mat unit in accordance with the present invention does not contain any toxic substances and will not affect the human body, and situations such as warpage, fragmentation or particle stripping will not occur.

In addition, the buffer plate 10 can prevent the barbell from bouncing on the exercise mat, thereby improving the safety of the user during exercise and improving the strength of the low vibration and noise reduction moving mat unit without damage. The protruding portions 20 can reduce the noise and vibration generated when the barbell impacts the exercise mat, thereby effectively reducing the influence on others, and the male buckles 12 and the female buckles 13 can increase the engagement strength between the exercise mat units of the exercise mat.

Furthermore, the rubber material of the buffer plate 10 and the rubber material of the protruding portions 20 are different from each other, and therefore the buffer plate 10 and the protruding portions 20 differ in hardness. The notch 16 is disposed around the periphery of the board, therefore the mat unit in accordance with the present invention does not need to be cut for disposal on the wall corner. In addition, the top surface of the board 11 is designed to form multiple rows of protrusions and channels on the top surface. With the height differences between the protrusions and channels, a barbell can be held in the channel and supported by adjacent protrusions to assist a user to replace the bar of the barbell easily.

Figure 8:
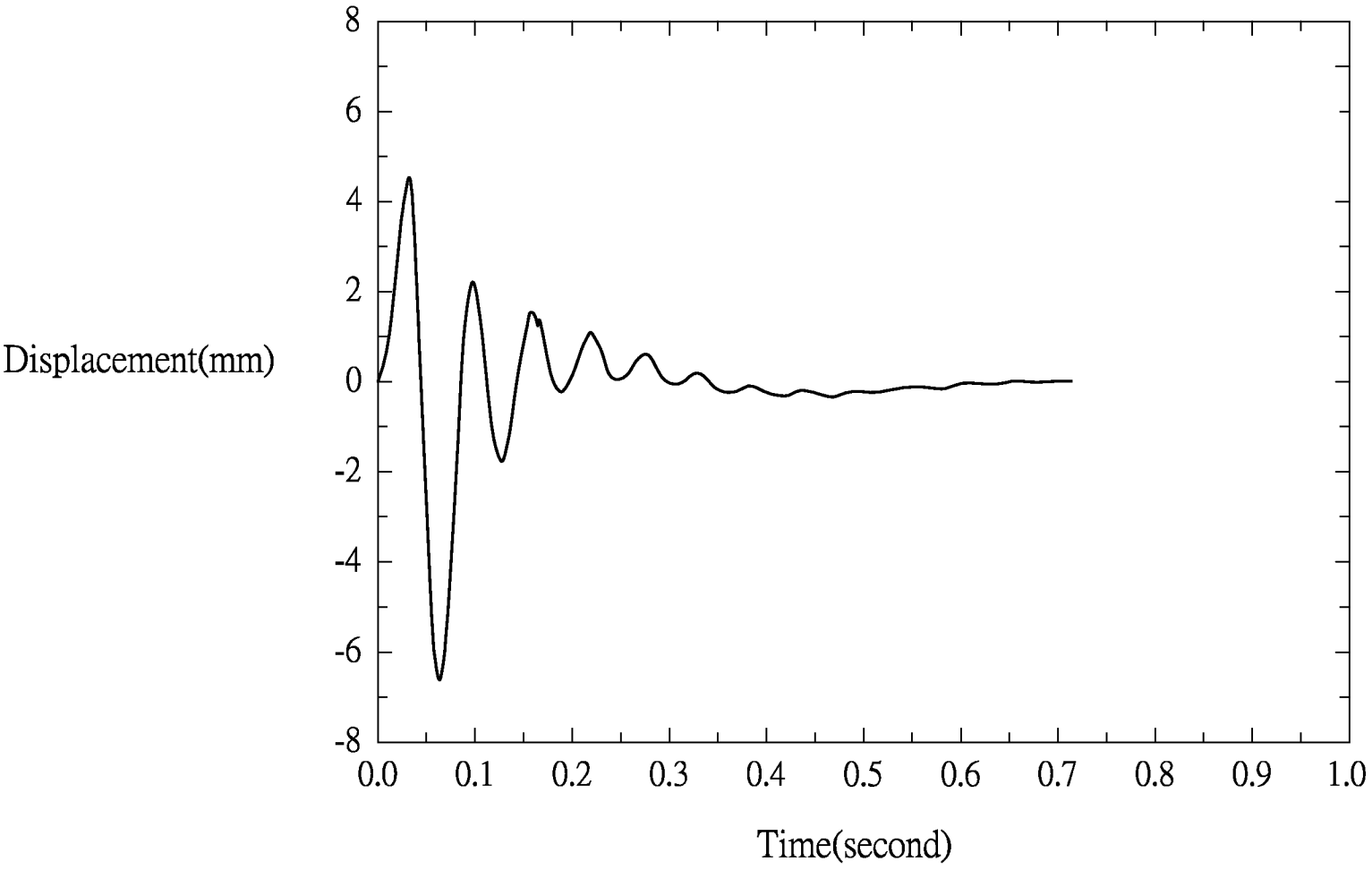
FIG. 8 is a diagram of oscillation experiment data of the buffer plate of the hardness 85°.
Figure 9:
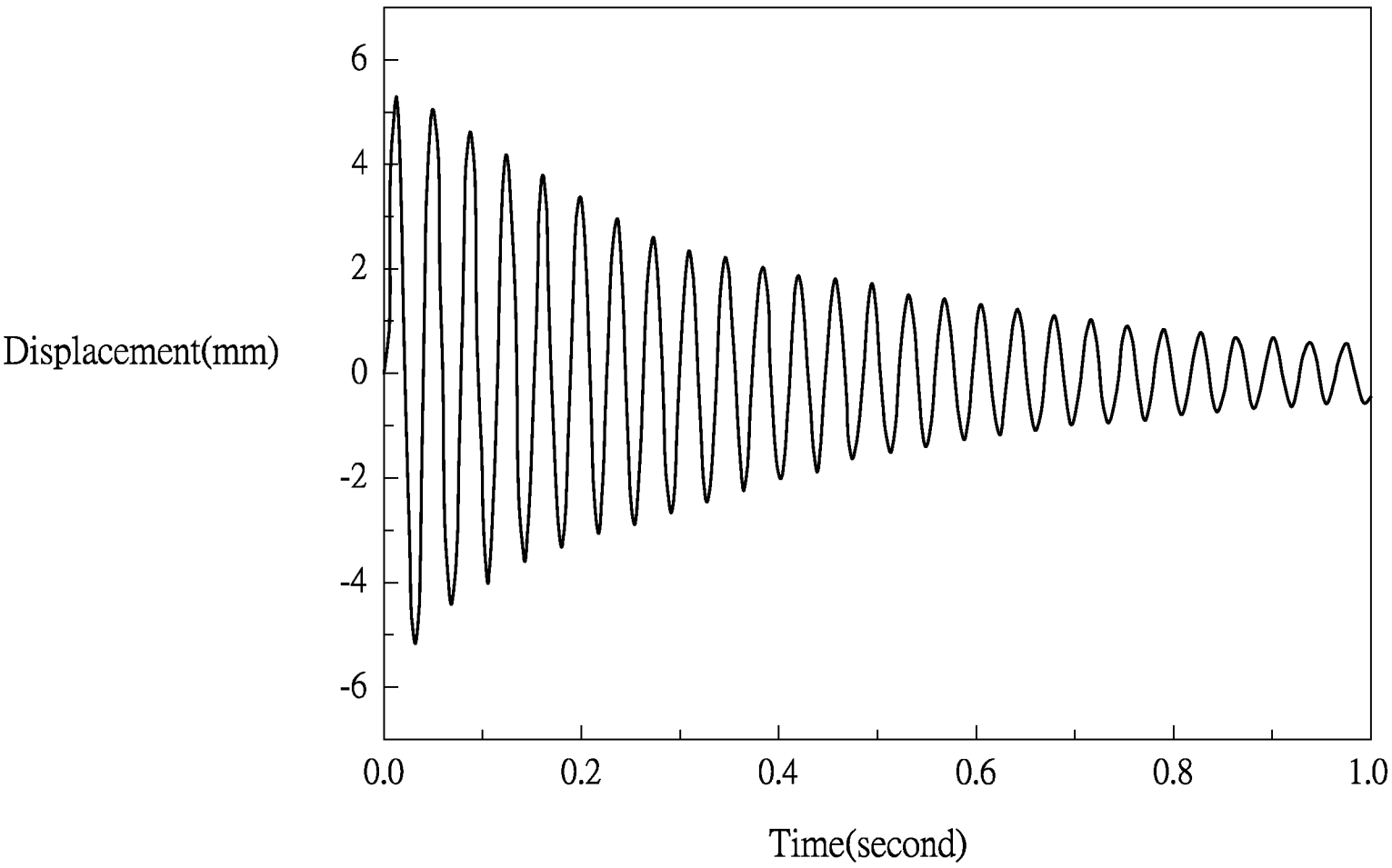
FIG. 9 is a diagram of oscillation experiment data of the buffer plate of the wood.
Figure 10:
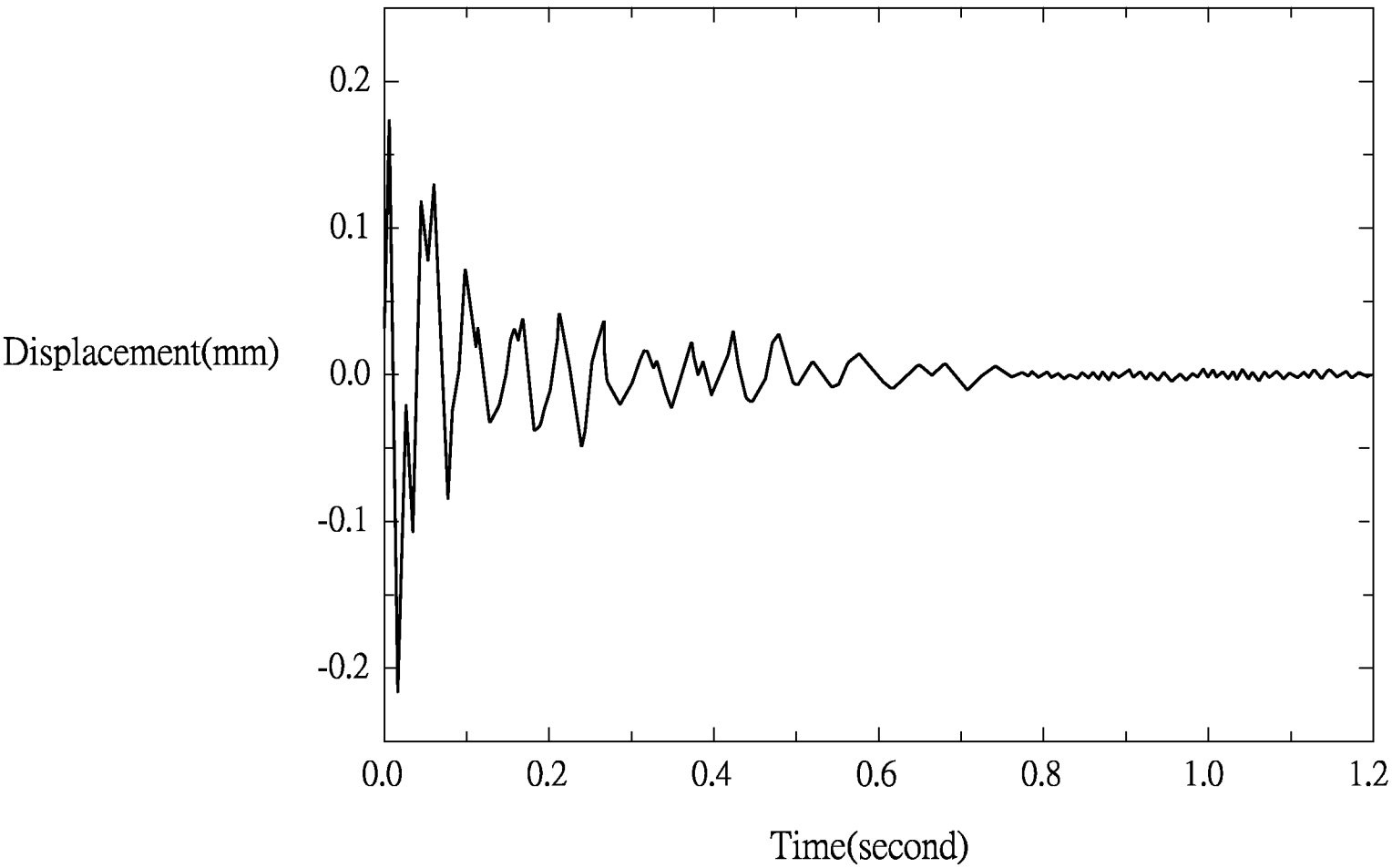
FIG. 10 is a diagram of experiment data of the decay rate of the buffer plate of the hardness 85°.

The buffer plate 10 is made of rubber having a hardness (JIS K 6301 A) of 85°. The oscillation experiment data of the buffer plate 10 is shown in FIG. 8, FIG. 8 shows that the butter plate can absorb vibration in short time. However, the oscillation experiment data of the wood is shown in FIG. 9. FIG. 9 shows the wood cannot absorb vibration in short time. Furthermore, with reference to FIG. 10, the experiment data shows that the buffer plate 10 has no second time bounce.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exercise mat unit comprising:

a buffer plate made of rubber having a hardness (JIS K 6301 A) of 80° to 90°, wherein a thickness of the buffer plate is 29.82 mm to 30.18 mm and the buffer plate having a quadrilateral board, wherein a top surface of the board is designed to form multiple intersected rows of protrusions and channels on the top surface and having a periphery;

a recess formed on a bottom surface of the board; and a flange formed around the recess;

multiple male buckles formed on the board;

multiple female buckles formed on the board, wherein the male buckles and the female buckles are arranged around the periphery of the board, the flange has a notch, and the notch is formed close to the female buckles; and multiple protruding portions disposed at spaced intervals in the recess of the board, and protruding downwardly from an inner top surface of the recess of the board, wherein the hardness of the multiple protruding portions is (JIS K 6301 A) of 35° to 55°.

2. The exercise mat unit as claimed in claim 1, wherein first connecting ribs are each respectively formed between adjacent two of the protruding portions, second connecting ribs are each respectively formed between the male buckles and the protruding portions, and the hardness of the first and second connecting ribs and the hardness of the protruding portions are the same.

3. The exercise mat unit as claimed in claim 1, wherein the protruding portions are one of, circular, oval or polygonal in shape.

4. The exercise mat unit as claimed in claim 2, wherein the protruding portions are one of, circular, oval or polygonal.

5. The exercise mat unit as claimed in claim 1, wherein each one of the male buckles has a hook protruding upwardly and formed on a top surface of the male buckle, and each one of the female buckles has a groove formed in the board and located in the recess.

6. The exercise mat unit as claimed in claim 2, wherein each one of the male buckles has a hook protruding upwardly and formed on a top surface of the male buckle, and each one of the female buckles has a groove formed on the board and located in the recess.

7. The exercise mat unit as claimed in claim 3, wherein each one of the male buckles has a hook protruding upwardly and formed on a top surface of the male buckle, and each one of the female buckles has a groove formed on the board and located in the recess.

8. The exercise mat unit as claimed in claim 4, wherein each one of the male buckles has a hook protruding upwardly and formed on a top surface of the male buckle, and each one of the female buckles has a groove formed on the board and located in the recess.

9. The exercise mat unit as claimed in claim 1, wherein the board has two pairs of two adjacent sides, the male buckles are formed on one of the pairs of two adjacent sides, and the female buckles are formed on the other pair of two adjacent sides.

10. The exercise mat unit as claimed in claim 2, wherein the board has two pairs of two adjacent sides, the male buckles are formed on one of the pairs of two adjacent sides, and the female buckles are formed on the other pair of two adjacent sides.

11. The exercise mat unit as claimed in claim 3, wherein the board has two pairs of two adjacent sides, the male buckles are formed on one of the pairs of two adjacent sides, and the female buckles are formed on the other pair of two adjacent sides.

12. The exercise mat unit as claimed in claim 4, wherein the board has two pairs of two adjacent sides, the male buckles are formed on one of the pairs of two adjacent sides, and the female buckles are formed on the other pair of two adjacent sides.

* * * * *